US008313178B2

(12) United States Patent
Studer et al.

(10) Patent No.: US 8,313,178 B2
(45) Date of Patent: Nov. 20, 2012

(54) FLUID DELIVERY SYSTEM

(75) Inventors: Anthony D. Studer, Corvallis, OR (US); Mark T. Hardin, Corvallis, OR (US); Karen A. St. Martin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1424 days.

(21) Appl. No.: 11/833,825

(22) Filed: Aug. 3, 2007

(65) Prior Publication Data

US 2009/0033724 A1 Feb. 5, 2009

(51) Int. Cl.
*B41J 2/175* (2006.01)

(52) U.S. Cl. ..... 347/85; 347/20

(58) Field of Classification Search ..... 347/92, 347/20, 85

See application file for complete search history.

(56) References Cited

U.S. PATENT DOCUMENTS

| | | | | |
|---|---|---|---|---|
| 4,589,000 | A * | 5/1986 | Koto et al. | 347/68 |
| 5,455,615 | A * | 10/1995 | Burr et al. | 347/92 |
| 5,737,001 | A | 4/1998 | Taylor | |
| 5,812,165 | A | 9/1998 | Boyd et al. | |
| 5,831,653 | A | 11/1998 | Brandon et al. | |
| 5,896,153 | A | 4/1999 | Swanson et al. | |
| 6,003,986 | A * | 12/1999 | Keefe | 347/92 |
| 6,113,223 | A * | 9/2000 | Tanaka et al. | 347/65 |
| 6,193,356 | B1 * | 2/2001 | Takata | 347/30 |
| 6,283,584 | B1 | 9/2001 | Powers et al. | |
| 6,331,055 | B1 | 12/2001 | Miller et al. | |
| 6,540,337 | B1 * | 4/2003 | Pollard | 347/65 |
| 6,682,186 | B2 | 1/2004 | Smith et al. | |
| 2003/0030709 | A1 * | 2/2003 | Deshmukh et al. | 347/92 |
| 2003/0142174 | A1 | 7/2003 | Boyd et al. | |
| 2003/0227525 | A1 | 12/2003 | Kim et al. | |
| 2004/0189760 | A1 * | 9/2004 | Ogawa et al. | 347/92 |
| 2006/0055748 | A1 | 3/2006 | Shaw | |
| 2006/0114304 | A1 * | 6/2006 | Buchanan et al. | 347/93 |
| 2006/0125892 | A1 * | 6/2006 | Buchanan et al. | 347/87 |
| 2006/0238557 | A1 * | 10/2006 | Studer et al. | 347/20 |
| 2007/0013754 | A1 * | 1/2007 | Haines et al. | 347/87 |

FOREIGN PATENT DOCUMENTS

| | | |
|---|---|---|
| KR | 1019980000924 | 3/1998 |
| KR | 1020050086711 | 8/2005 |

OTHER PUBLICATIONS

International Search Report dated Nov. 27, 2008.
European search report for EP 08827039 dated Jul. 29, 2010.

* cited by examiner

*Primary Examiner* — Charlie Peng
*Assistant Examiner* — Peter Radkowski

(57) ABSTRACT

Various embodiments and methods relating to delivering fluid through a standpipe and one or more slots are disclosed.

26 Claims, 13 Drawing Sheets

FLUID DELIVERY SYSTEM

BACKGROUND

As shown by FIG. 9, standpipe 224 has a floor 264 which includes sloped or ramped portions 265 that slope or ramp towards slots 226. As a result, ramped portions 265 form an angle with the vertical walls 265 of standpipe 224 that is greater than 90 degrees and also forms an angle with a top of slots 226 that is greater than 90 degrees. Such larger transition angles reduce the likelihood of air bubbles becoming trapped or lodged along floor 264 and proximate to slots 226 where they may at least partially occlude flow of printing fluid. According one embodiment, floor 264 extends at an angle of at least about 160 degrees and nominally about 150 degrees with respect to vertical walls 265 and forms an angle of at least about 130 degrees and nominally about 120 degrees with respect to a top of slots 226. In other embodiments, floor 264 may extend at other angles or may alternatively extend perpendicular to walls 265.

DETAILED DESCRIPTION OF THE EXAMPLE EMBODIMENTS

Figure 1:
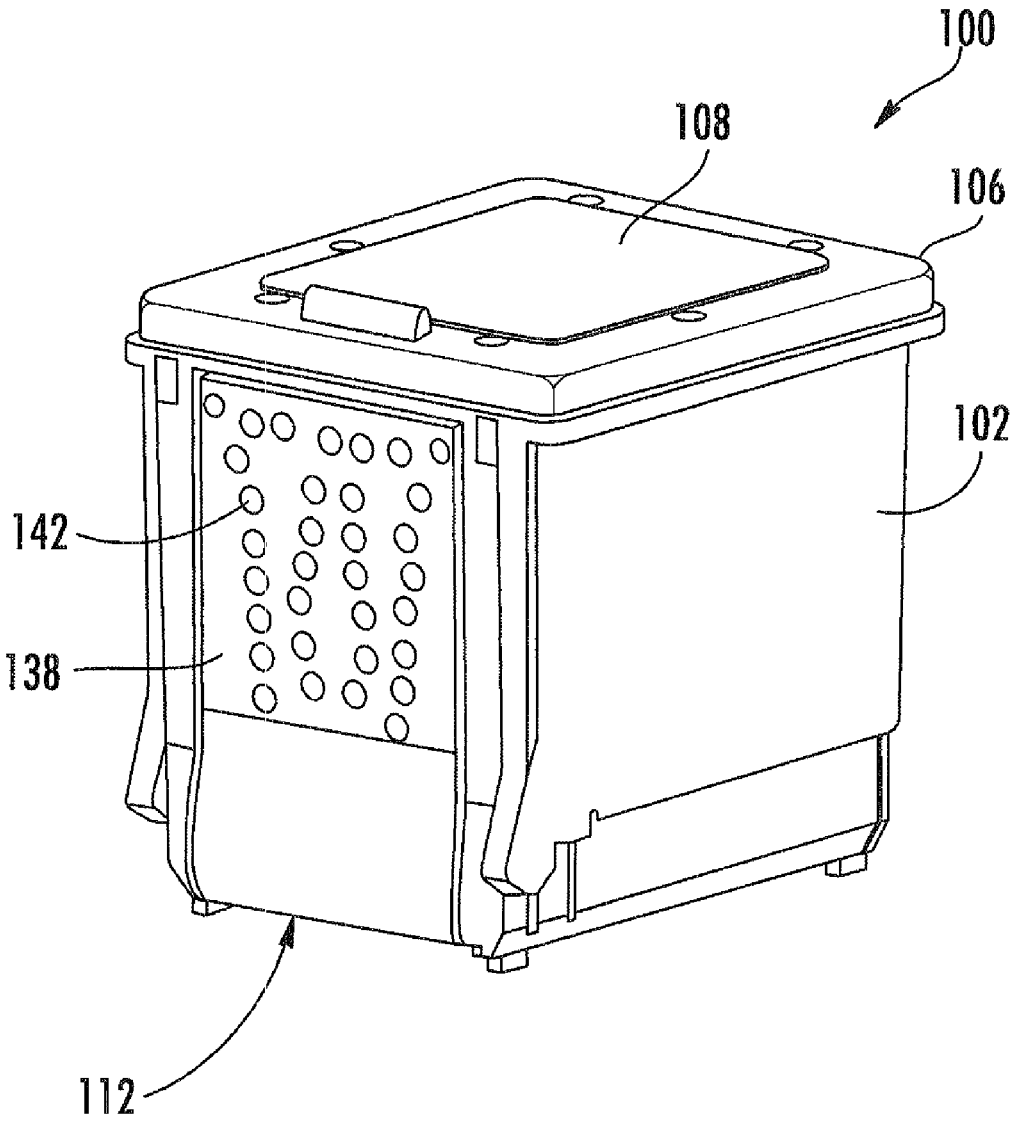
FIG. 1 is a top perspective view of a print cartridge according to an example embodiment.

FIGS. 1-4 illustrate a print cartridge 100, also known as and ink-jet cartridge or a drop-on-demand inkjet cartridge, according to an example embodiment. Print cartridge 100 is configured to be mounted in a print device, wherein the print cartridge 100 stores printing fluid and selectively ejects the printing fluid under control of the printing device. Print cartridge 100 includes a body 102, back pressure mechanism 104, lid 106, cover 108, filter 110 and head assembly 112.

Body 102 comprises one or more structures configured to at least temporarily store and contain fluid, such as ink, and to further deliver or pass the stored fluid to head assembly 112 for printing. Body 102 includes a fluid chamber 120 and a fluid delivery system 122 which includes a standpipe 124, one or more slots 126, support 128 and a head assembly receiving recess 130. Fluid chamber 120 comprises a chamber, cavity or other volume configured to at least temporarily contain and store fluid to be printed using cartridge 100. Although chamber 120 is illustrated as containing a volume of fluid that is consumed until insufficient amounts remain for printing, in other embodiments, chamber 120 may be configured to be replenished with fluid via an off-axis ink supply or upon being removed from a printing device in which cartridge 100 employed.

Fluid delivery system 122 delivers the printing fluid or ink from chamber 120 to head assembly 112. Fluid delivery system 122 includes standpipe 124 and one or more slots 126. Standpipe 124 extends between chamber 120 and slots 126 and comprises an elongate passage through which the printing fluid flows. Slots 126 comprise fluid passages configured to deliver the printing fluid to the fluid ejecting portion of head assembly 112. Support 128 transversely extends across standpipe 124 and slots 126 so as to structurally support walls 132 defining slots 126. Recess 130 receives and positions portions of head assembly 112 adjacent to and opposite to slots 126. In the example illustrated, body 102 is integrally formed as a single unitary body. In other embodiment, one or more components of body 102 may be fastened, welded, bonded, or otherwise connected to one another. As will be described in more detail hereafter, fluid delivery system 122 facilitates the breakup and/or moving of air bubbles that maybe generated during printing away from slots 126 and towards an end of standpipe 124 proximate chamber 120. As a result, such air bubbles are less likely to interfere with the delivery of printing fluid through slots 126 to head assembly 112.

Back pressure mechanism 104 comprises one or more structures configured to generate back pressure within chamber 120. In the example illustrated, back pressure mechanism 104 may comprise a capillary medium, such as foam, for exerting a capillary force on the printing fluid to reduce the likelihood of the printing fluid leaking. In other embodiments, other back pressure mechanism may be employed such as a spring bag, bellows or spring bag and bubble generator.

Lid 106 comprises a cap configured to contain printing fluid within chamber 120. In example illustrated, lid 106 includes an arrangement or labyrinth of vent channels on its topside and a communication with its bottom side, permitting airflow into chamber 120. Cover 108, also known as a vent label, is secured over lid 106 and covers portions of the vent channels. In other embodiments, lid 106 may omit such vents or may have other configurations. Cover 108 may also have other configurations or may be omitted.

Figure 4:
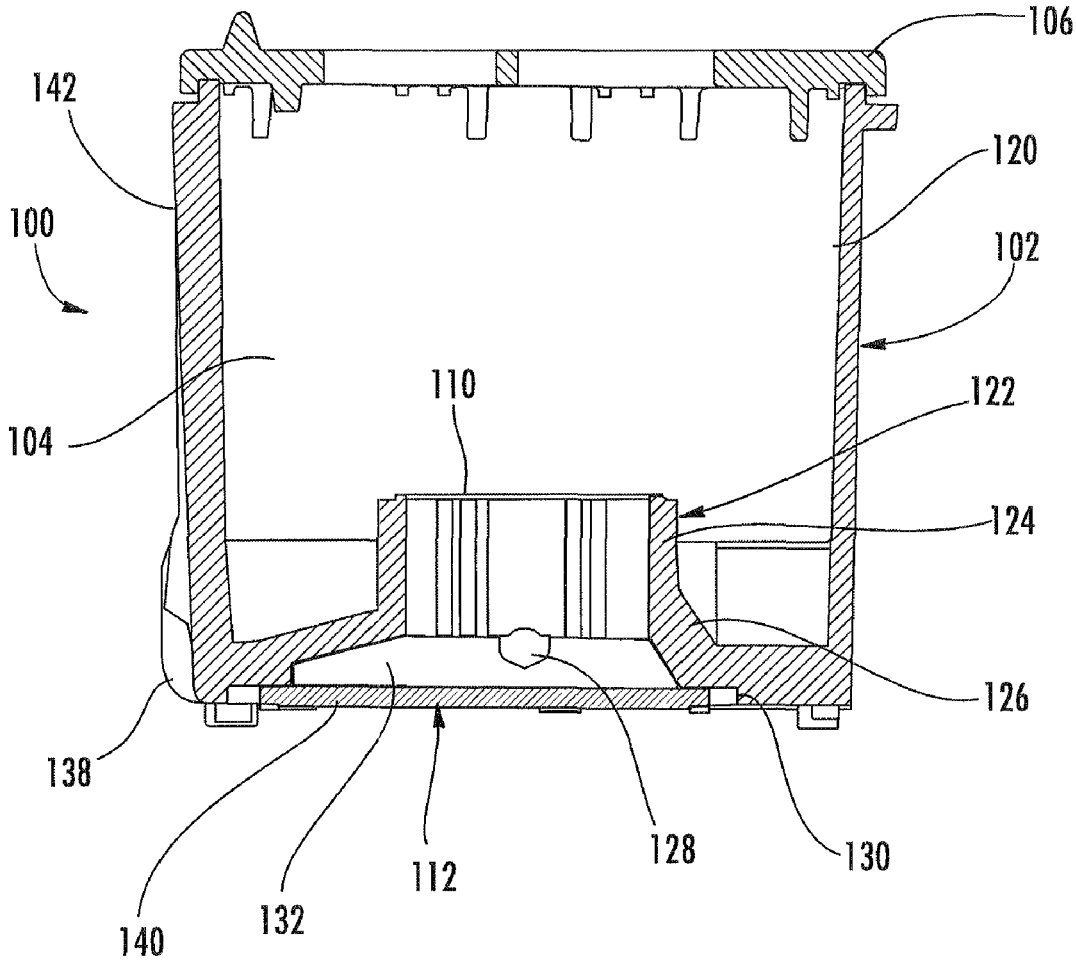
FIG. 4 is a sectional view of the print cartridge of FIG. 1 according to an example embodiment.

Filter 110 comprises one or more mechanisms configured to filter the printing fluid prior to the printing fluid entering standpipe 124 of fluid delivery system 122. As shown by FIG. 4, filter 110 extends across and over standpipe 124 between standpipe 124 and chamber 120. In one embodiment, filter 110 comprises a stainless steel filter screen material permanently staked onto standpipe 124. In other embodiments, filter 110 may comprise other materials and/or may be secured to or across standpipe 124 in other fashions.

Head assembly 112 comprises an assembly of components configured to selectively discharge or eject printing fluid onto a printing surface. In one embodiment, head assembly 112 comprises a drop-on-demand inkjet head assembly. In one embodiment, head assembly 112 comprises a thermoresistive head assembly. In other embodiments, head assembly 112 may comprise other devices configured to selectively deliver or eject printing fluid onto a medium.

Figure 2:
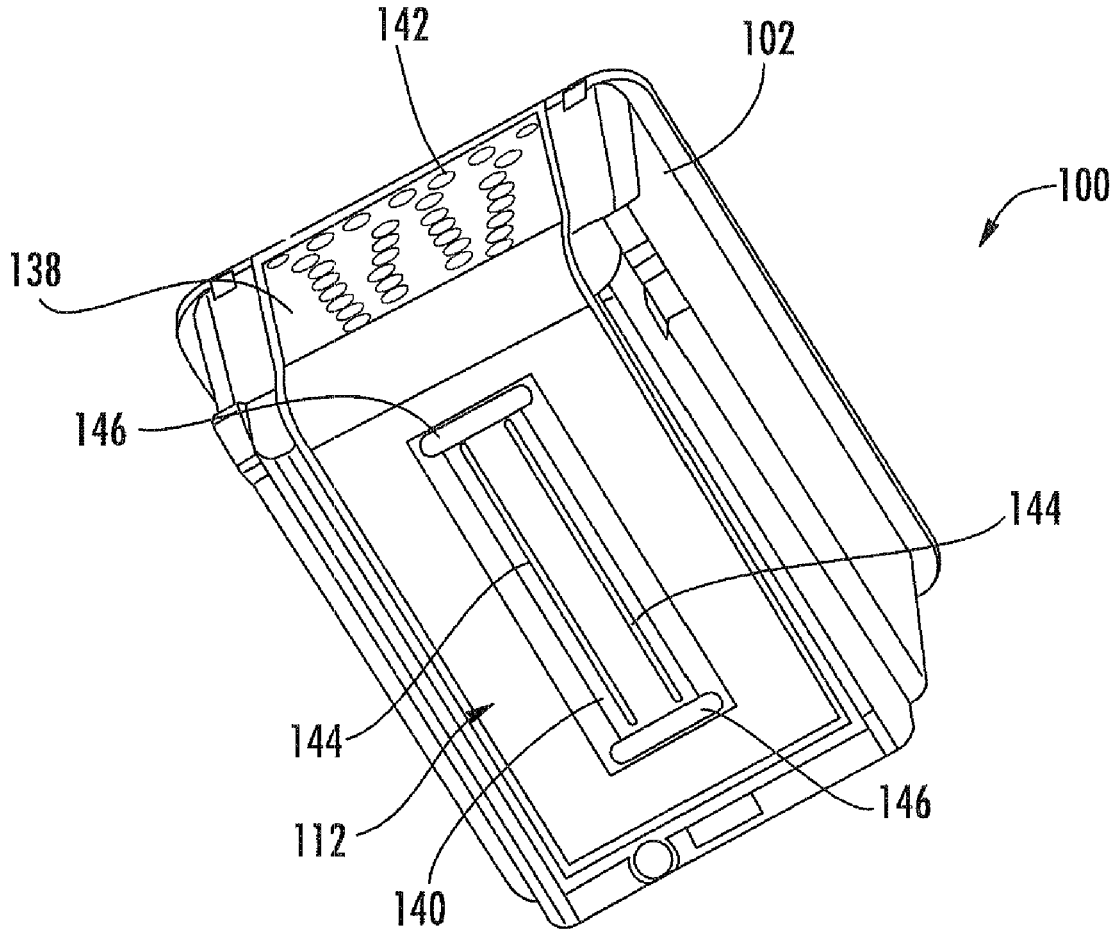
FIG. 2 is a bottom perspective view of the print cartridge of FIG. 1 according to an example embodiment.
Figure 3:
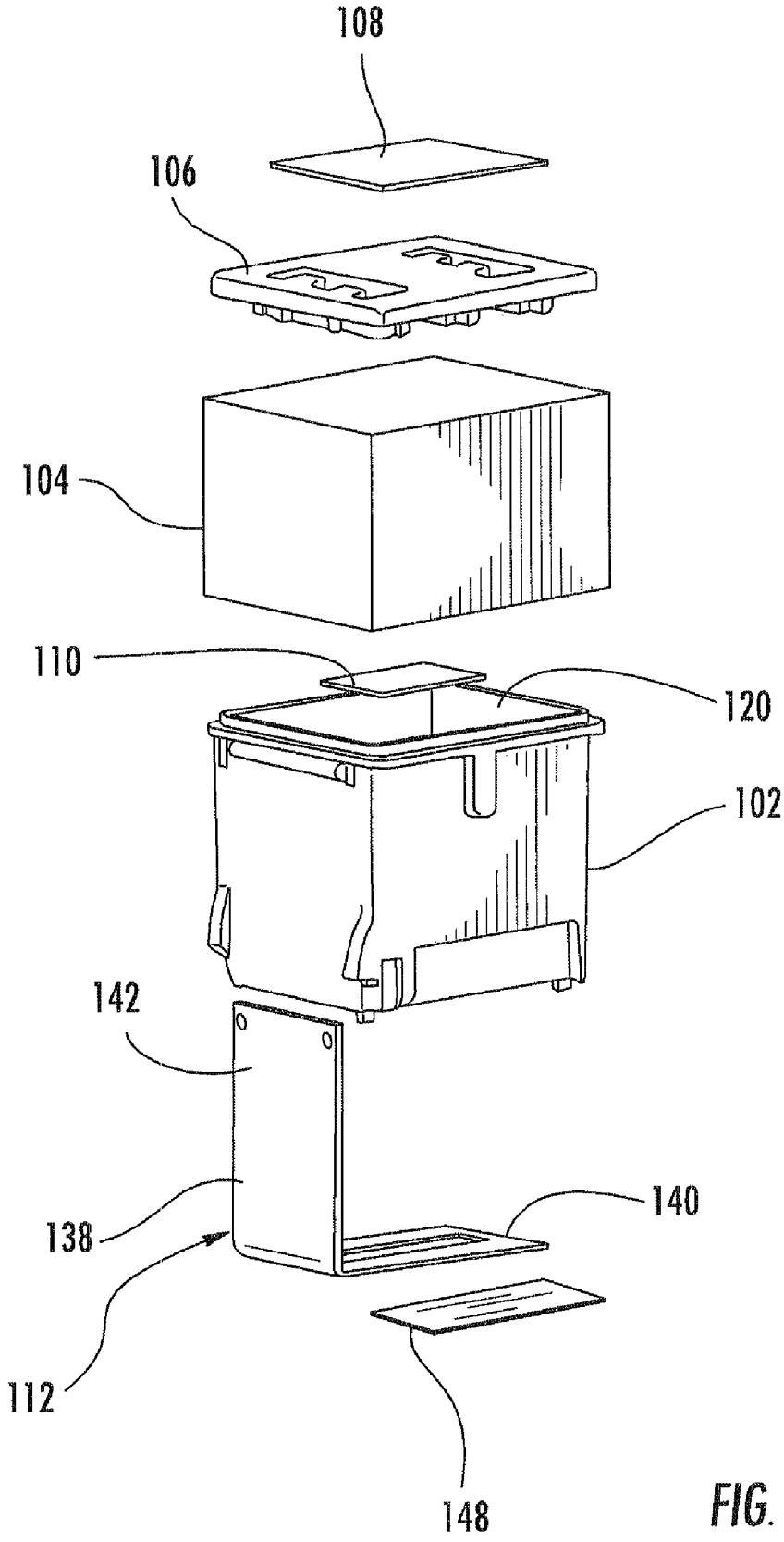
FIG. 3 is an exploded perspective view of the print cartridge of FIG. 1 according to an example embodiment.

In the particular embodiment illustrated, head assembly 112 comprises a tab head assembly (THA) which includes flexible circuit 138, print head die portion 140 and electrical contacts 142. Flexible circuit 138 comprises a band, panel or other structure of flexible bendable material, such as one or more polymers, supporting or containing electrical lines, wires or traces that extend between contacts 142 and die portion 140. Flexible circuit 138 supports die portion 140 and contacts 142. As shown by FIGS. 1 and 2, flexible circuit 138 wraps around body 102.

Die portion 140 is configured to selectively eject printing fluid based on signals received from contacts 142. Die portion 140 includes feed slots, firing circuitry (not shown), encapsulates 146 and orifice plate 148 (shown in FIG. 3). Feed slots 144 comprises slots or channels which are generally narrower than slots 126 and which deliver printing fluid to firing circuitry. In one embodiment in which head assembly 112 comprises a thermoresistive print head, such firing circuitry may include resistors which are configured to generate heat so as to vaporize portions of the printing fluid to forcibly expel drops a printing fluid through orifices in orifice plate 148. In embodiments where head assembly 112 comprises a piezo resistive print head, such firing circuitry may include resistors and associated piezo resistive elements which change shape, expand or deflect to force printing fluid through orifices in orifice plate 148. In yet other embodiment, the firing circuitry may have other configurations.

Encapsulates 146 comprise one or more material which encapsulate electrical interconnects that interconnect electrically conductive traces or lines of die portion 140 with electrically conduct of lines or traces of flexible circuit 138 which are connected to electrical contacts 142. In other embodiments, encapsulates 146 may have other configurations or may be omitted.

Electrical contacts 142 extend generally orthogonal to die portion 140 and comprise pads configured to make electrical contact with corresponding electrical contacts of the printing device in which cartridge 100 is employed.

Orifice plate 148 comprises a plate or panel having a multitude of orifices which define nozzle openings through which the printing fluid is ejected. Orifice plate 148 is mounted or secured opposite to slots 144 and their associated firing circuitry. In other embodiment, orifice plate 148 may be omitted where such orifices or nozzles are otherwise provided.

As noted above, fluid delivery system 122 of body 102 provides more reliable delivery of printing fluid from chamber 120 to slots 144 and their firing circuitry. In particular, during printing, air may be generated within slots 144. This air may form bubbles in the printing fluid. In many printing devices in which standpipe 124 and slots 126 are oriented in a substantially vertical orientation and are maintained in a substantially vertical orientation during printing, such air bubbles simply float to a top of the standpipe 124 and rest against screen 110, where such air bubbles are warehoused over the life of the print cartridge while providing an adequate ink path for delivering printing fluid to slots 144.

However, it has been discovered that in print devices that print in a sideways or horizontal orientation or which are repeatedly oriented in a sideways orientation prior to, during or after printing, such air bubbles may accumulate and become trapped on surfaces inside slots 126 or lower portions of standpipe 124 to a point that the fluid supply path provided by standpipe 124 and slots 126 to head assembly 112 is at least partially occluded or blocked. It has been discovered that this problem is exacerbated with print cartridges having a relatively high density of relatively small orifices or nozzles (such as 1200 dots per inch) and with the use of particular printing fluids that are configured to aggressively dry. Standpipe 124 and slots 126 of ink delivery system 122 address such issues by facility breakup of such air bubbles or by facilitating movement of such air bubbles towards filter 110.

Figure 5:
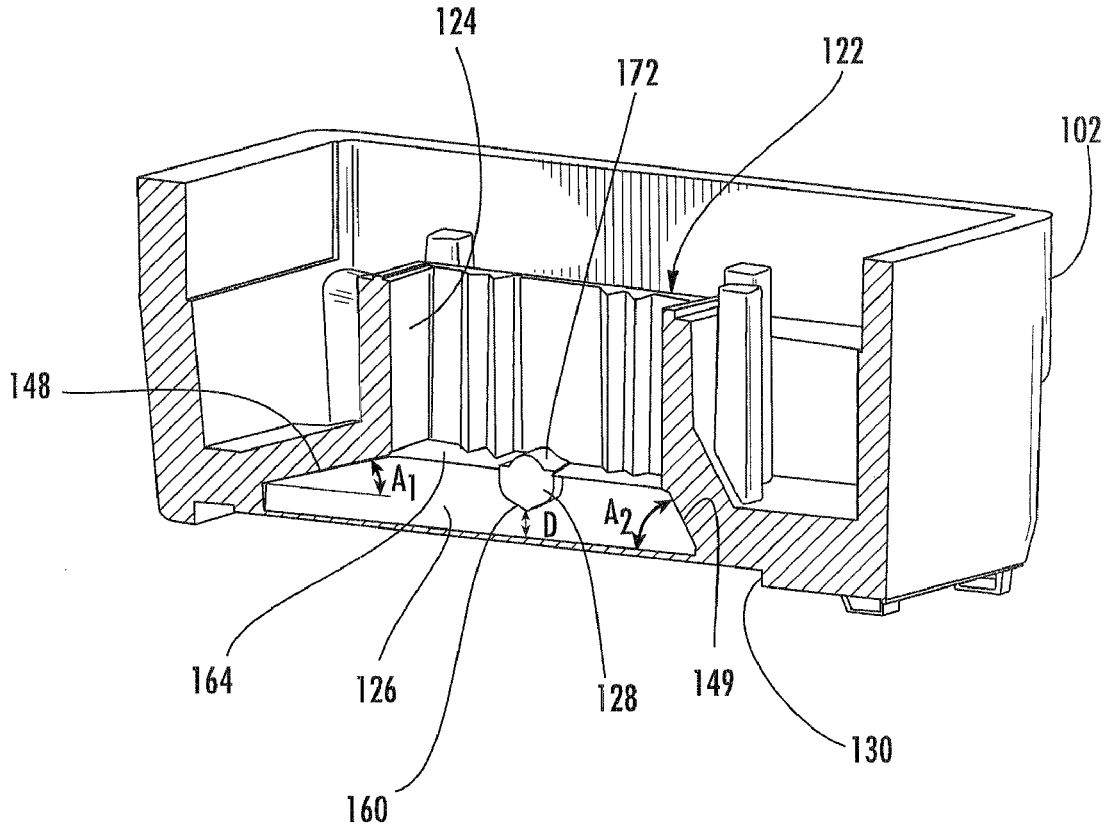
FIG. 5 is a fragmentary sectional view of a body of the print cartridge of FIG. 1 according to an example embodiment.
Figure 6:
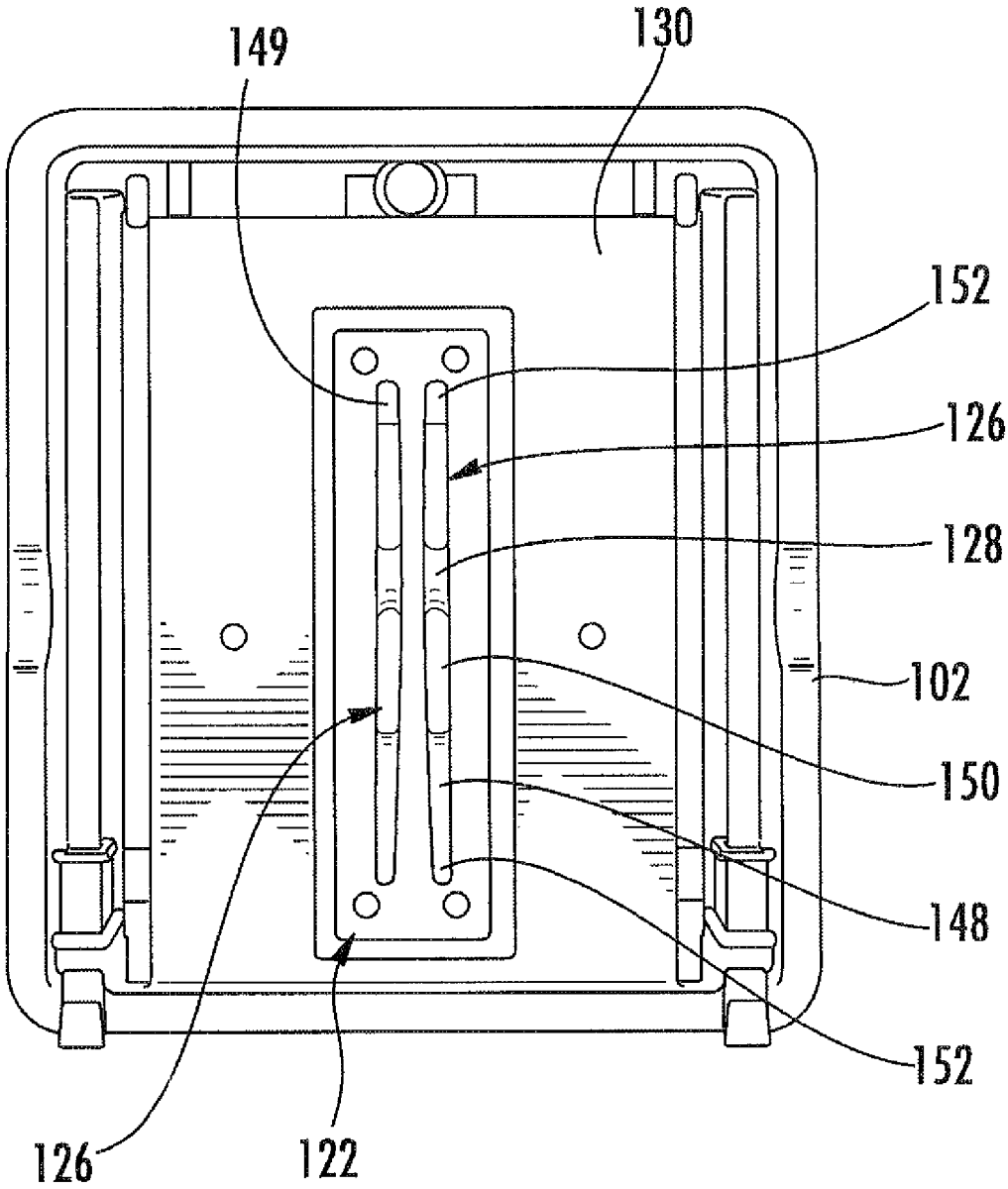
FIG. 6 is a bottom plan view of the body of FIG. 5 according to an example embodiment.
Figure 7:
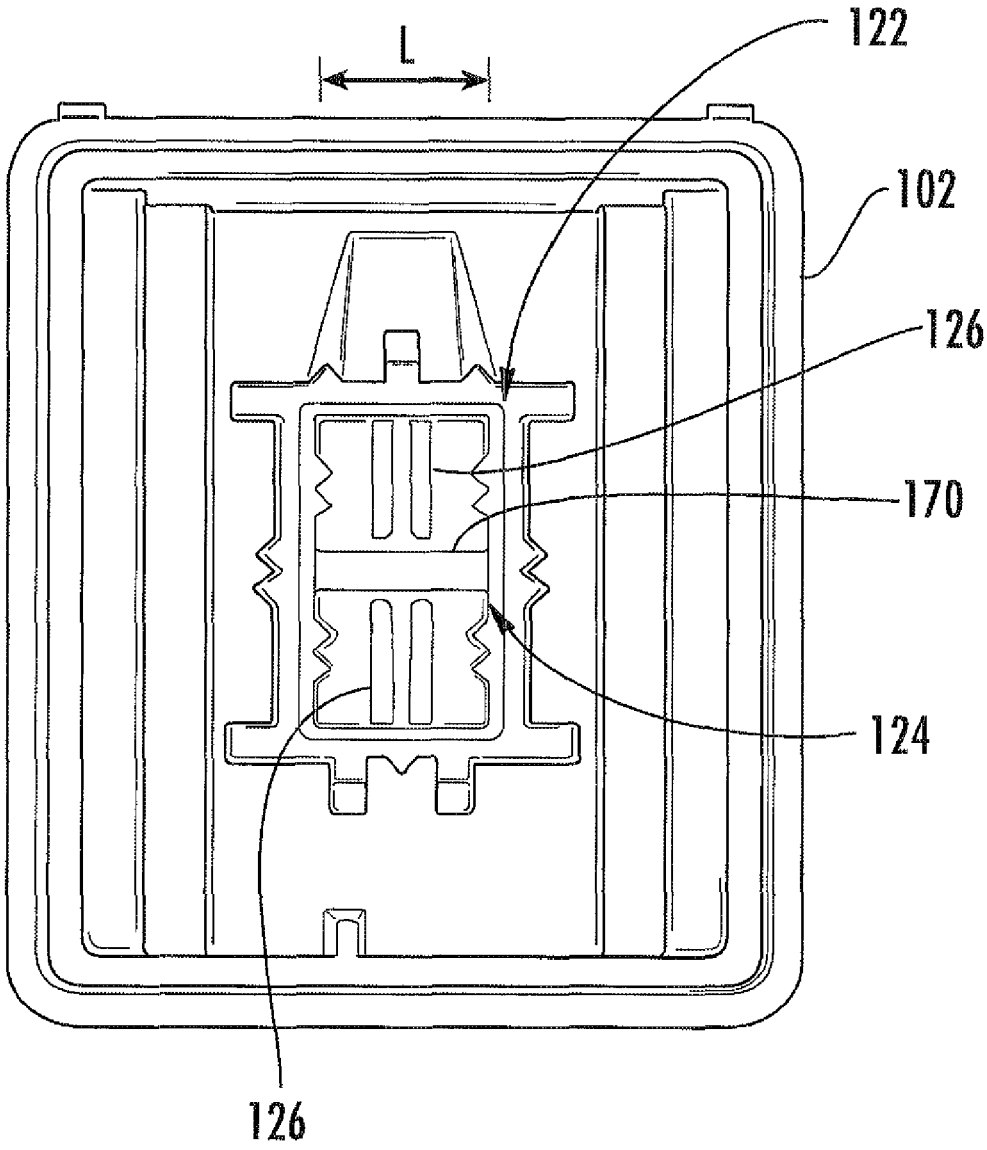
FIG. 7 is a top plan view of the body of FIG. 5 according to an example embodiment.

FIGS. 5-7 illustrate a lower portion of body 102 and those features of fluid delivery system 122 which facilitate either the breakup or movement of air bubbles in more detail. As shown by FIG. 5, standpipe 124 has a reduced length as compared to slots 126. As a result, the size of filter 110 (shown in FIGS. 3 and 4) may be reduced. By reducing the size of filter 110, costs and recycling benefits are achieved. However, this may result in ceilings or shelf areas 148, 149 along the top of slots 126. It has been discovered that air bubbles sometimes accumulate or become lodged or trapped against such shelf areas 148.

To facilitate movement of air bubbles along shelf areas 148, fluid delivery system 122 (1) increases velocity of the flow of printing fluid across shelf areas 148, 149 and (2) provides a smoother, more vertical transition long shelf areas 148, 149 to standpipe 124. As shown by FIG. 6, slots 126 have elongate lower orifices 150 along recess 130 through which printing material flows to head assembly 112 (shown in FIG. 3). Each orifice 150 has narrowing or tapering end portions 152. Because end portions 152 are narrowed and taper, end portions 152 increase a velocity of the printing fluid flowing through end portions 152. This increased velocity of fluid flow serves to dislodge bubbles.

As shown by FIG. 5, shelf areas 148, 149 extend at angles that facilitate bubble movement toward standpipe 124. In particular, shelf area 148 extends at an angle A1 of at least about 14 degrees and nominally about 15 degrees. Shelf area 149 extends at an angle A2 of at least about 54 degrees and nominally about 60 degrees. As a result, air bubbles are less likely to become trapped or lodged against shelf areas 148, 149 and better move along such shelf areas 148, 149 toward standpipe 124. In other embodiments, the angle A2 of shelf area 149 may be reduced while increasing the angle A1 of shelf area 148.

It has further been discovered that air bubbles may sometimes accumulate or become lodged against support 128. To reduce a likelihood of such air bubbles becoming lodged against an underside of support 128, the lower surface 160 of support 128 is spaced from the bottom face of slots 128 and from recess 130 by a distance D of at least 0.7 mm and nominally at least about 0.9 mm. Likewise, the two faces on the underside of support 128 have been angled to facilitate the movement of bubbles. As a result, air bubbles are less likely to be trapped within slot 126 between support 128 and head assembly 112 (shown in FIG. 3). As the print height of the head assembly 112 is increased, the feed slot length 144 increases accordingly and so does the length of the elongate lower orifices 150 formed in body 102. In order to mold body 102 as a unitary piece, one or more support structures 128 are provided. In other embodiments, support structure 128 may be omitted.

It has also been discovered that air bubbles may sometimes accumulate or become lodged upon the floor 164 of standpipe 124. To facilitate break up or movement of such air bubbles, floor 164 includes one or more protuberances projecting from floor 164 towards and into standpipe 124. In particular, as shown by FIGS. 5 and 7, fluid delivery system 122 includes a protuberance 170 formed on a top side of support 128 and projecting into standpipe 124. Protuberance 170 extends equidistantly from opposite ends of slots 126 and extends generally perpendicular to slots 126. In one embodiment, protuberance 170 projects at least about 0.3 mm into standpipe 124. In one embodiment, protuberance 170 has a length L substantially across an entire width of standpipe 124. As shown by FIG. 5, in one embodiment, protuberance 170 has a rounded curved upper surface 172, reducing the extent of corners in which air bubbles may be retained.

In other embodiments, upper surface 172 of protuberance 170 may be sharp or pointed to facilitate breakup of air bubbles. In other embodiments, protuberance 170 may project into standpipe 124 by other distances and may be provided at other locations. In yet other embodiments, protuberance 170 may be omitted.

FIGS. 8-11 illustrate print cartridge 200, another embodiment of print cartridge 100. Print cartridge 200 is similar to print cartridge 100 except that print cartridge 200 includes a body 202 in place of body 102. Those remaining components of print cartridge 200 which correspond to previously described components of print cartridge 100 are numbered similarly.

Figure 10:
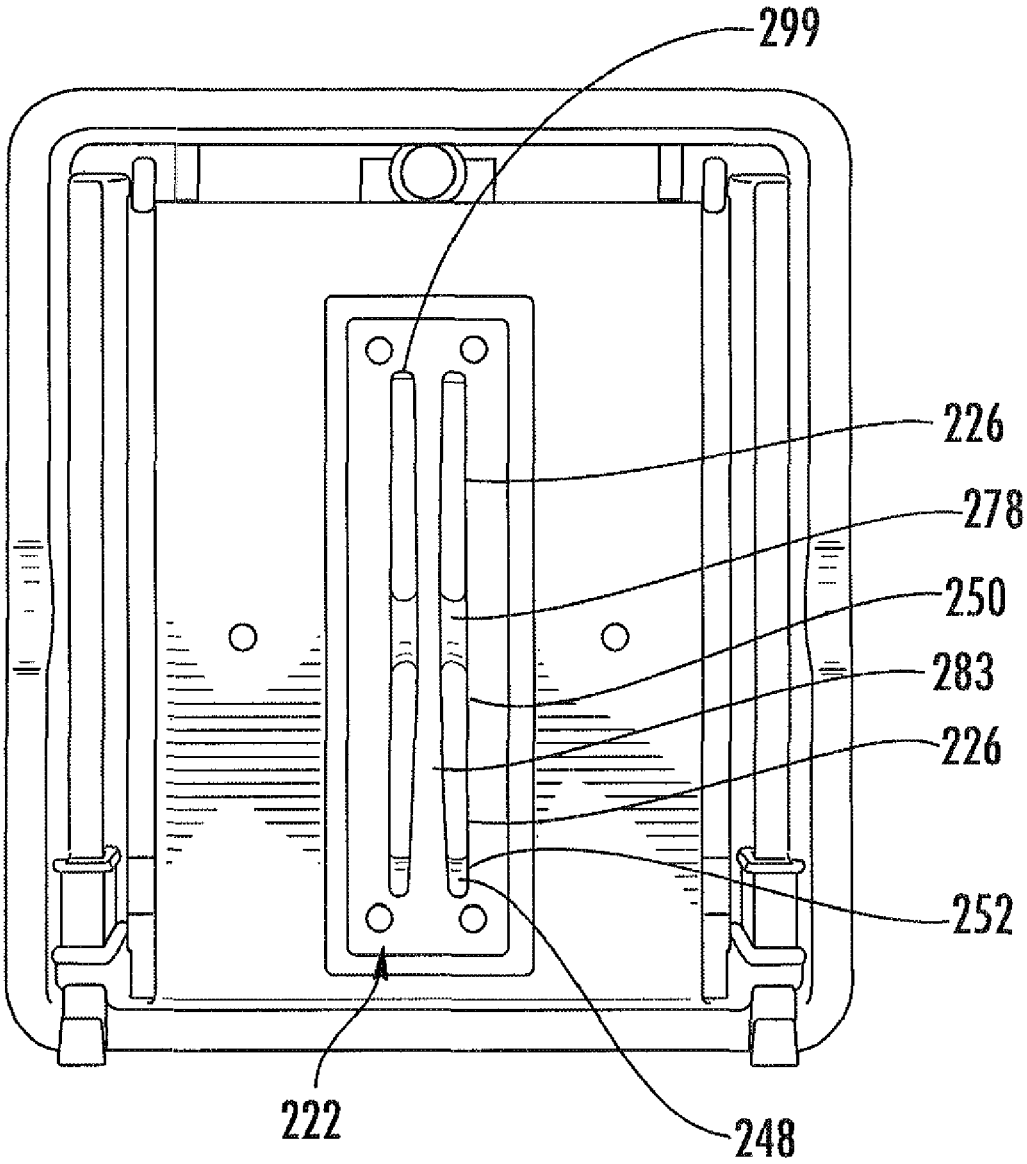
FIG. 10 is a bottom plan view of the body of FIG. 9 according to an example embodiment.

Like body 102, body 202 of print cartridge 200 includes a fluid delivery system 222 is configured to facilitate either the breakup of air bubbles or the movement of air bubbles away from fluid flow blocking or congesting locations. As shown by FIG. 10, like fluid delivery system 122, fluid delivery system 222 includes slots 226 having lower orifices 250 with tapered or narrowed end portions 252 generally opposite to shelf portions to 48, 249. End portions 252 provide constricted flow areas that increase the velocity of fluid flow through end portions 252 to facilitate dislodgment of air bubbles along shelf portions 248, 249. In other embodiments, such narrowing of end portions 252 may be omitted.

Figure 8:
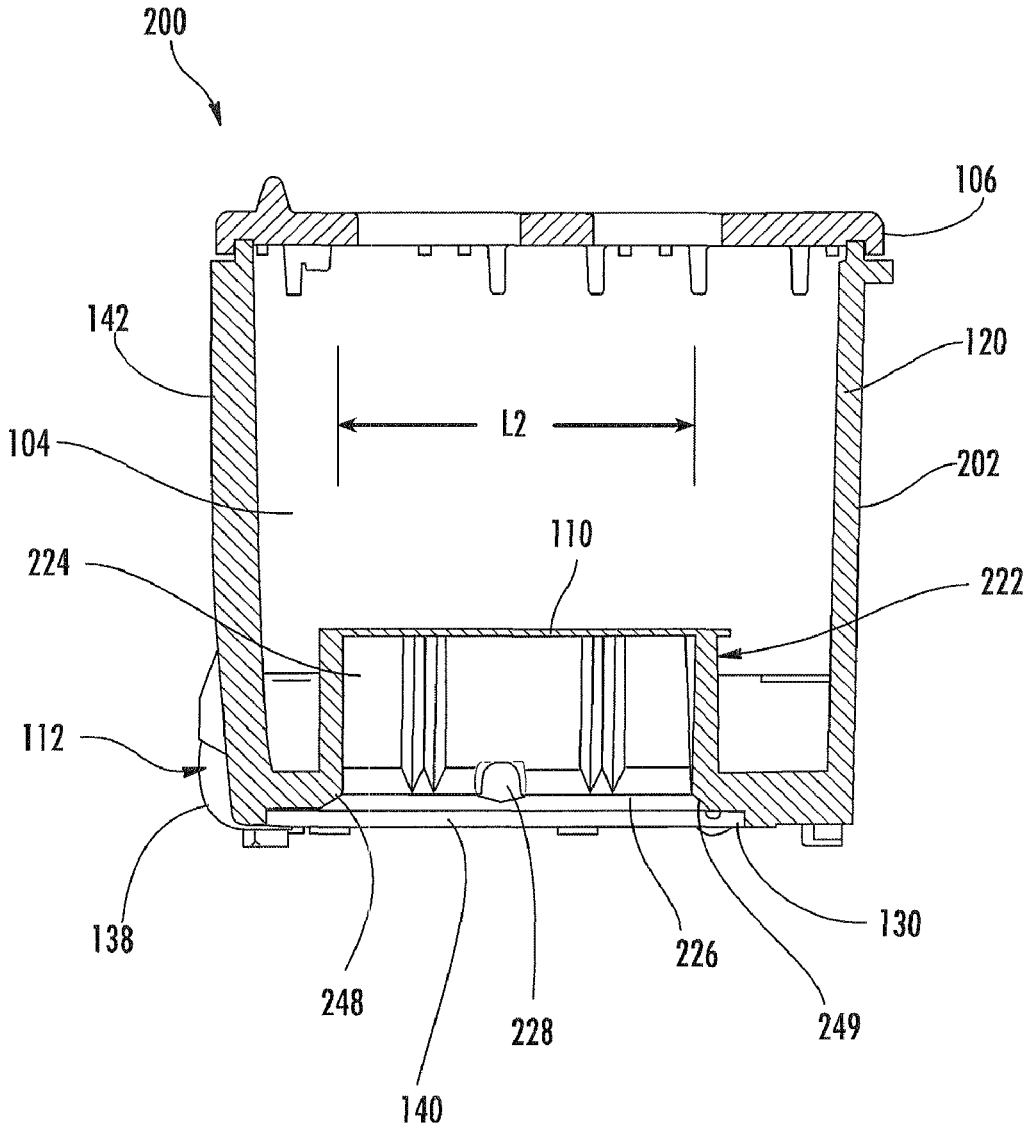
FIG. 8 is a sectional view of another embodiment of the print cartridge of FIG. 1 according to an example embodiment.
Figure 9:
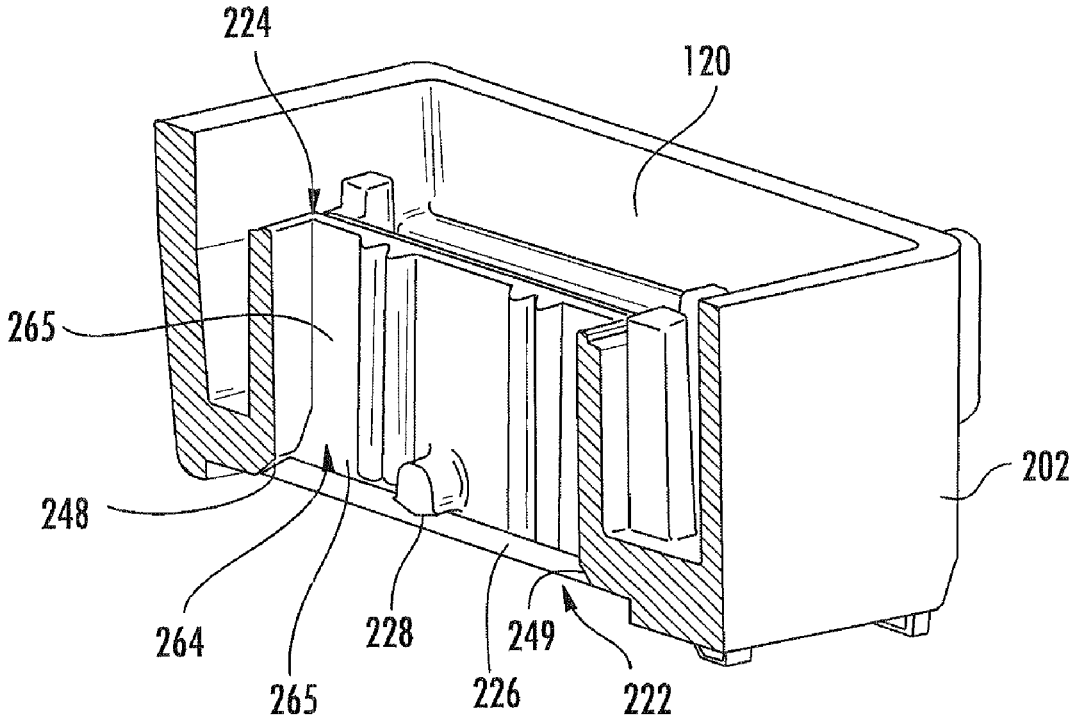
FIG. 9 is a fragmentary sectional view of a body of the print cartridge of FIG. 8 according to an example embodiment.

As shown by FIGS. 8 and 9, in contrast to body 102, standpipe 224 of fluid delivery system 222 has an increased length L2. This increased length L2 reduces the extent of shelf areas 248, 249, reducing a surface area against which air bubbles may accumulate or become lodged. In one embodiment, to counter an extent to which filter 110 must be increased in size, the width of standpipe 224 (extending into the page of FIG. 8) is reduced. As shown by FIGS. 8 and 9, like shelf areas 148, 149, shelf areas 248, 249 provide transition surfaces having increased angles. In the example illustrated, shelf area 248 extends at an angle of at least about 14 degrees and nominally about 15 degrees. Shelf area 249 extends at an angle of at least about 54 degrees and nominally about 60 degrees. As a result, air bubbles are less likely to become trapped or lodged against shelf areas 248, 249 and better move along such shelf areas 248, 249 toward standpipe 224. In other embodiments, the angles of shelf area 249 may be reduced while increasing the angle of shelf area 248.

Like support 128 of fluid delivery system 122, support 228 of fluid delivery system 222 is spaced from a lower face of slots 226 and recess 130 by a distance of at least 0.7 mm and nominally at least about 0.9 mm. As a result, air bubbles are less likely to be trapped within slots 226 between support 228 and head assembly 112 (shown in FIG. 8). In other embodiment, support 228 may be spaced from the lower face of slots 226 by other distances or may be omitted.

As shown by FIG. 9, standpipe 224 has a floor 264 which includes sloped or ramped portions 265 that slope or ramp towards slots 226. As a result, ramped portions 265 form an angle with the vertical walls 265 of standpipe 224 that is greater than 90 degrees and also forms an angle with a top of slots 226 that is greater than 90 degrees. Such larger transition angles reduce the likelihood of air bubbles becoming trapped or lodged along floor 264 and proximate to slots 226 where they may at least partially occlude flow of printing fluid. According one embodiment, floor 264 extends at an angle of at least about 160 and nominally about 150 with respect to vertical walls 265 and forms an angle of at least about 130 and nominally about 120 with respect to a top of slots 226. In other embodiments, floor 264 may extend at other angles or may alternatively extend perpendicular to walls 265.

Figure 11:
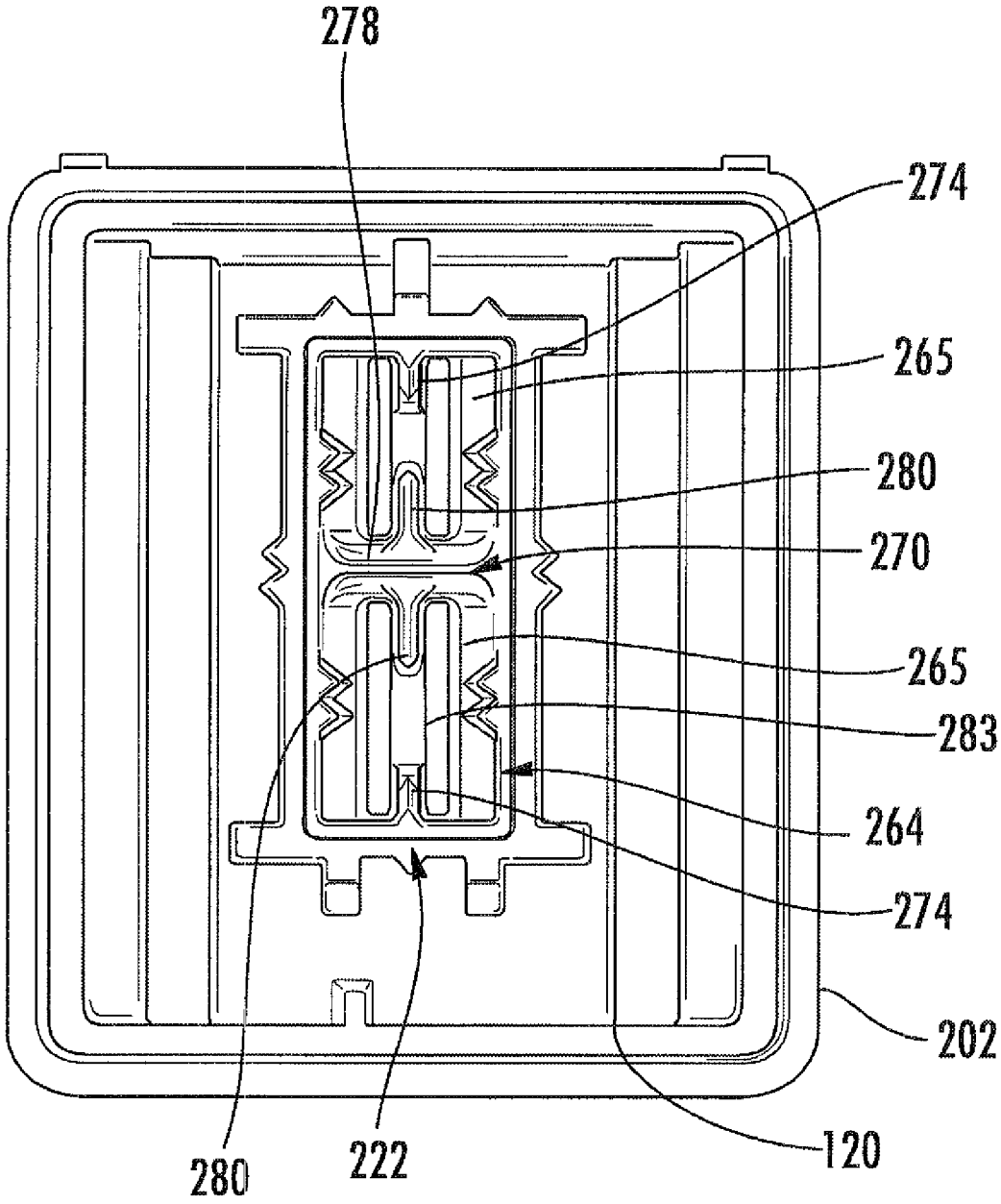
FIG. 11 is a top plan view of the body of FIG. 9 according to an example embodiment.

As with floor 164 of standpipe 124, floor 264 of standpipe 224 includes one or more protuberances projecting from floor 264 towards and into standpipe 224. FIG. 11 is a top plan view of body 202 of FIG. 9 illustrating floor 264. As shown by FIG. 11, floor 264 includes protuberance 270 and protuberances 274. Protuberance 270 projects from floor 264 into standpipe 224 and includes a main or central portion 278 and oppositely extending extensions 280. Portion 278 is similar to protuberance 170 in that portion to 278 is formed on a topside of support 228 and projects into standpipe 224. Portion 278 extends equidistantly from opposite ends of slots 226 and extends generally perpendicular to slots 226. In one embodiment, portion 278 projects at least about 0.8 mm into standpipe 224. In one embodiment, portion 278 has a length L substantially across an entire width of standpipe 224. As shown by FIG. 9, in one embodiment, portion 278 has a rounded curved upper surface, reducing the extent of corners in which air bubbles may be retained. Likewise, the two faces on the underside of protuberance 270 have been angled to facilitate the movement of bubbles.

Extensions 280 comprise protuberances extending from an intermediate wall 283 between slots 226 into standpipe 224. Extensions 280 project from opposite sides of portion 278 substantially parallel to slots 226. In one embodiment, extensions 280 project at least 0.8 mm and nominally 1.2 mm into standpipe 224. In one embodiment extensions 280 extend at least 1 mm and nominally about 2.3 mm from opposite sides of portion 278. In other embodiments, extensions 280 may have other dimensions or may be omitted.

Protuberances 274 comprise projections or bumps extending from floor 264 into standpipe 224 proximate to opposite ends of slots 226. Protuberances 274 project upwardly from intermediate wall 283 between slots 226. Protuberances 274 extend generally parallel to slots 226. According to one embodiment, protuberances 274 each have a height selected project into standpipe 224 by a least 1 mm and nominally about 1.8 mm. Extensions 274 each have a length projecting from axial ends of slots 226 towards central portion 278 of protuberance 270 by a distance of at least about 1 mm and nominally about 1.5 mm. In other embodiment, protuberances 274 may have other dimensions or may be omitted.

As with body 102, body 202 and the components of fluid delivery system 222 are integrally formed as a single unitary body. In other embodiment, one or more components of body 202 and fluid delivery system 222 may be fastened, welded, bonded, or otherwise connected to one another.

Overall, fluid delivery system 222 of cartridge 200 provides a more aggressive solution to breaking up air bubbles or facilitating movement of air bubbles out of congesting locations. End portions 252 increase the velocity of fluid flow to assist in dislodging air bubbles. Shelf areas 248, 249 have enlarged angles to reduce the likelihood of air bubbles becoming lodged against such shelf surfaces. Support 228 is spaced from head assembly 112 by a relatively large distance to inhibit trapping of air bubbles between support 228 and head assembly 112. Ramped portions 265 facilitate movement of air bubbles through standpipe 264. Protuberances 270 and 274 more aggressively breakup air bubbles or facilitate dislodgment of air bubbles from floor 264. Although each of such features synergistically cooperates with one another to break up or move air bubbles, in other embodiments, such features may be provided in other combinations or may be used independently of one another.

Figure 12:
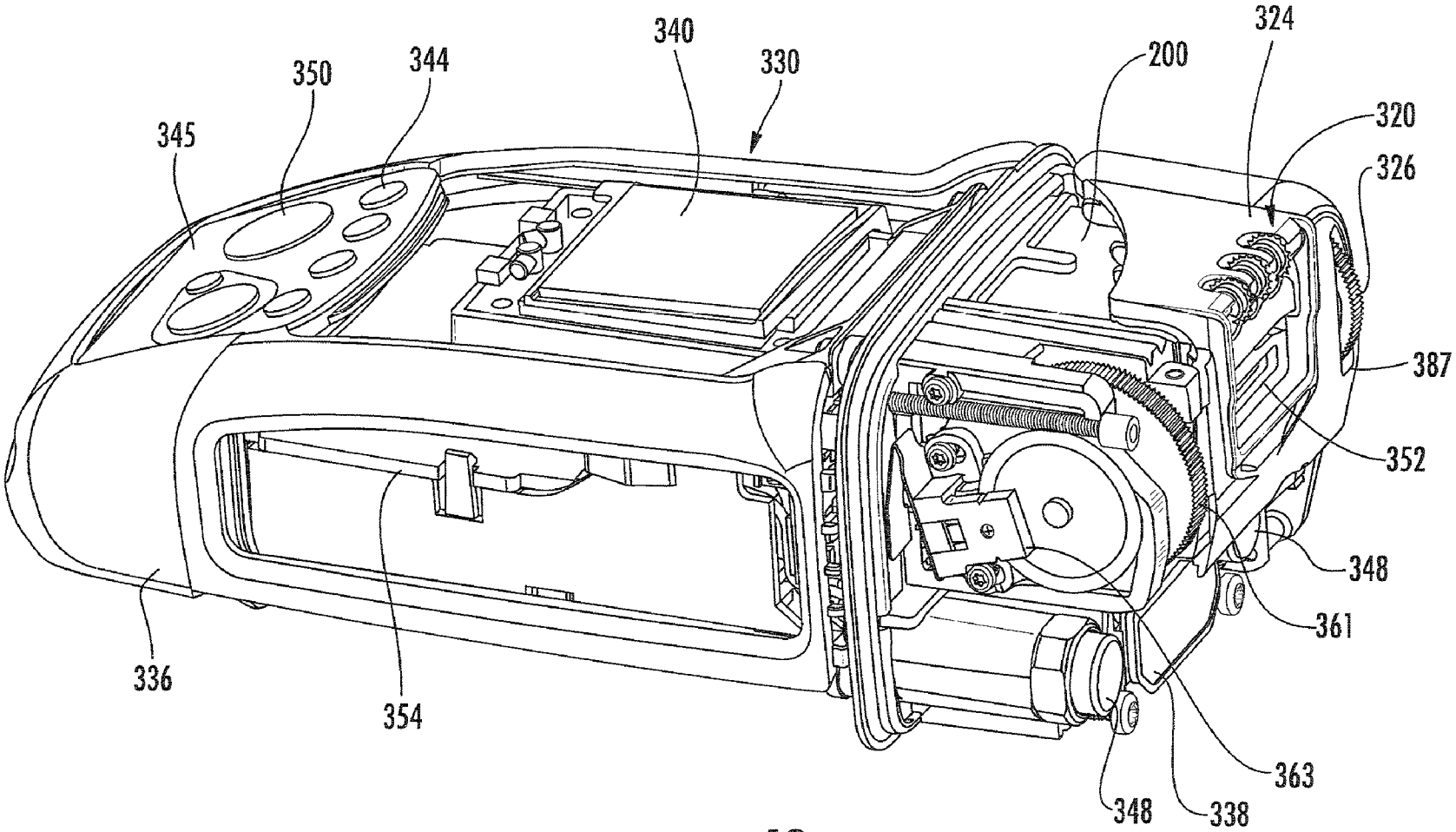
FIG. 12 is a top perspective view of a print device including the cartridge of FIG. 8 according to an example embodiment.
Figure 13:
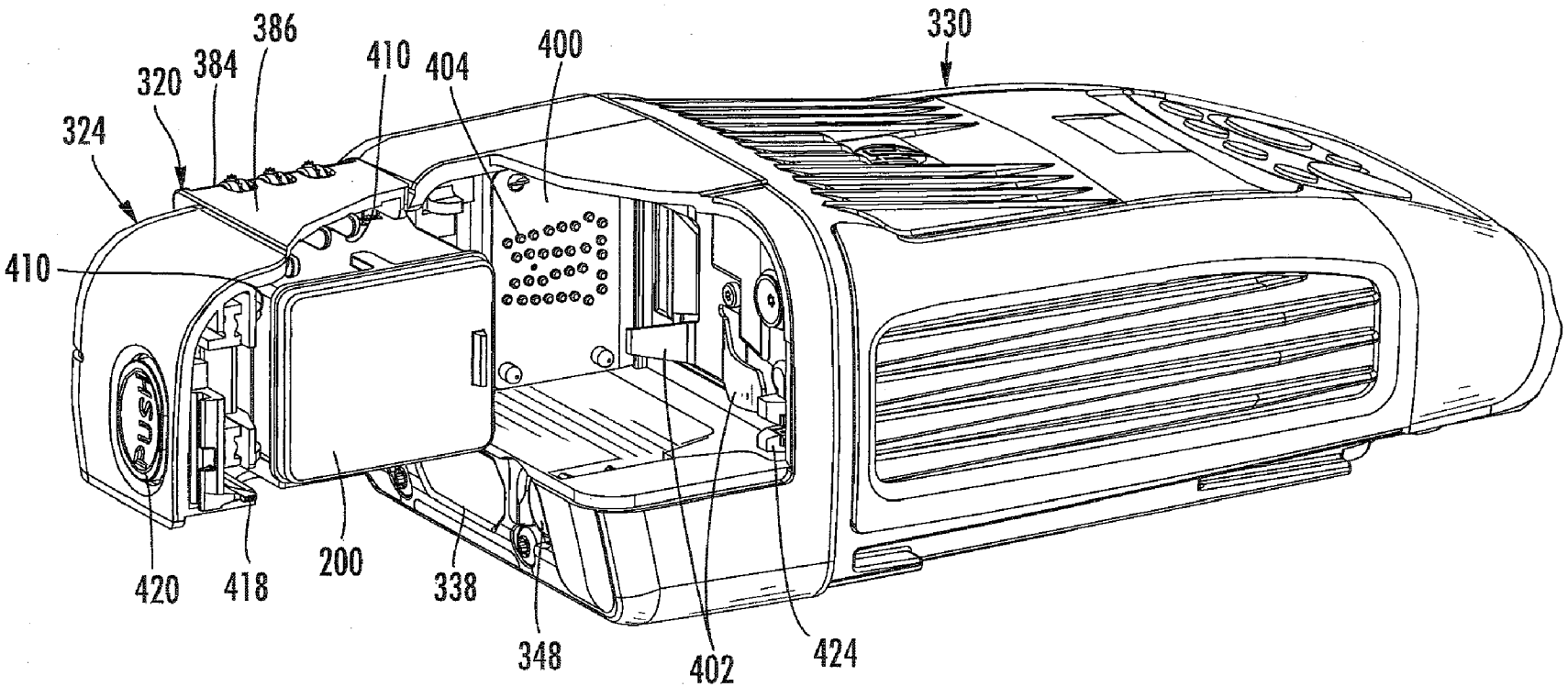
FIG. 13 is a top perspective view of the print device of FIG. 12 illustrating loading of the print cartridge of FIG. 8 according to an example embodiment.

As noted above, print cartridges 100 and 200 and their associated fluid delivery systems 120, 220 are especially advantageous in print devices which print while in a sideways orientation. Likewise, print cartridges 100 and 200 are also advantageous in print devices which may be stored, carried and used to print in multiple orientations. FIGS. 12 and 13 illustrate one example of a print device, (capture and print unit 330) including cartridge 200. Print unit 330 is configured to print while in a horizontal or substantially horizontal orientation. In the example illustrated, capture and print unit 330 is configured to capture or send data or image from a surface and to print data or image onto the same surface or a different surface based upon the captured or sends data. Capture and print unit 330 includes body 336, imager 338, communication interface 340, indicator 344, user interface 345, print sensor 346, sensor 348, manual trigger 350 and controller 354.

Body 336 comprises a structure or case configured to support the remaining components of capture and print unit 330. Body 336 at least partially encloses or houses such components. In one embodiment, body 336 is configured such that capture and print unit 330 is a hand held unit. As shown in FIG. 12, body 336 is a block, cylinder or similar structure configured to be grasped by a person's hand with the person's fingers wrapped about body 336. In the particular embodiment illustrated, body 336 is formed from a thermally conductive material such as a metal (e.g. magnesium) to enhance cooling of internal componentry of capture and print unit 330. In other embodiments, body 336 may be formed from other materials such as plastic materials or combinations of plastics, metals or other materials.

Imager 338 is configured to sense, scan or capture an image upon a surface. In one embodiment, imager 338 comprises a scanner module comprising a two dimensional (2D) Imaging Scanner and one or more illumination sources such as targeted light emitting diodes, facilitating omni-directional scanning a in lowlight conditions. In other embodiments, imager 338 may comprise other devices configured to sense or capture the visible image such as other forms of a camera or other two dimensional (2D) charge coupled devices (CCD) and the like. In yet other embodiments, imager 338 may utilize ultraviolet or infrared light to scan or sense an image on surface. In one embodiment, imager 338 may be configured to read a code such as a Maxi code, barcode, Universal Product Code (UPC) and the like.

Communication interface 340 is configured to communicate with external electronic devices such as external data sources (not shown). Communication interface 340 is configured to transmit data as well as to receive data. In one embodiment, communication interface 340 is configured to communicate wirelessly with external electronic devices. For example, in the particular embodiment illustrated, communication interface 340 is configured to communicate with radio waves and comprises wireless IEEE 802.11g module. In such an embodiment, the metallic housing of body 336 enhances cooling and dissipation of the heat generated by communication interface 340. In other embodiments, communication interface 340 may communicate with ultraviolet or infrared light. In still other embodiments, communication interface 340 may be a wired connection where communication occurs through electrical or optical cables. In other embodiments, where a data source is incorporated into capture and print unit 330 as part of controller 354 and its memory, communication interface 340 may be omitted.

Indicator 344 comprises one or more devices configured to provide an indication of when print device 342 is ready for printing. Indicator 344 further provides an indication of when image capture has been initiated and when capture and print unit 330 is in sufficiently close proximity to a surface for printing upon the surface. In the embodiment illustrated, indicator 344 comprises a plurality of light emitting diodes configured to emit different colors of light or configured to emit light which is filtered by different colored light filters, wherein the different colors of light indicate or communicate different information to a person using unit 330. In other embodiments, indicator 344 may have other configurations. For example, indicator 344 may additionally or alternatively be configured to provide distinct audible signals or sounds based on the state of capture and print unit 330. In yet other embodiments, indicator 344 may be omitted.

User interface 345 comprises an interface by which a person may enter commands instructing capture and print unit 330 to initiate printing with print device 342. For example, upon receiving an indication that print device 342 is at an appropriate temperature for printing from indicator 344, a person may actuate or otherwise enter a command via interface 345 to begin printing. In the example embodiment illustrated, user interface 345 comprises a pair of buttons, When depressed manually actuates switches to create electoral signals which are transmitted to controller 354. In other embodiments, interface 345 may comprise a touch pad, lever, switch, slide or other device by which a person may use his or her hands or fingers to enter a command. In another embodiment, user interface 345 may comprise a microphone with associated voice or speech recognition software. In yet other embodiments, user interface 345 may be omitted where other mechanisms are employed for initiating printing. For example, in one embodiment, printing may be initiated in response to signals received from print sensor 346.

Print sensor 346 comprises a sensing device configured to detect relative movement of capture and print unit 330, and in particular, print device 342, relative to a surface being printed upon. Signals from print sensor 346 indicate the relative speed at which print device 342 is moving relative to the surface being printed upon or vice versa. Signals from print sensor 346 are used by controller 354 to control the rate at which printing material is discharged from print device 342 and which particular nozzles are being discharged to form an image. In the particular embodiment illustrated, print sensor 346 is further configured to indicate contact or sufficiently close proximity of print device 342 to the surface and the initiation of printing. In other embodiments, the initiation a printing may alternatively begin in response to actuation of a separate trigger such as to the use of interface 345.

In the example embodiment illustrated, print sensor 346 comprises an encoder wheel 361 and associated encoder 363 wherein the encoder wheel 361 is rotated a long the surface being printed upon. In other embodiments, print sensor 346 may comprise a navigational sensor or other sensing device.

Sensor 348 comprises a device configured to sense an image separation distance between the surface having an image and sensor 348 or imager 338. Sensor 348 generates and transmits signals to controller 354, wherein controller 354 determines an image separation distance using such signals and generates a warming signal initiating the capture of an image by imager 338 and readying of print device 342.

According to one embodiment, sensor 348 detects the image separation distance without contacting the surface being printed upon. In one embodiment, sensor 348 comprises an ultrasonic circuit or sensor. As shown by FIG. 12, in the embodiment illustrated, sensor 348 comprises a pair of ultrasonic ranging sensors located on either side of imager 338 for enhanced detection of image separation distance separating the surface to be scanned for an image and imager 338. In other embodiments, sensor 348 may comprise other ultrasonic sensors or may comprise other non-contact type sensors such as infrared sensors. In still other embodiments, sensor 348 may comprise a sensor which contacts the surface being scanned or read when determining the image separation distance.

Manual trigger 350 comprises a user or human interface configured to permit a user or person to initiate the generation of a trigger signal. In one embodiment, manual trigger 350 may be configured to generate a trigger signal in response to contact with or force exerted by a person's hand or one or more fingers. For example, manual trigger 350 may comprise a button, slide, trigger structure or other structure.

Controller 354 comprises one or more processing units physically associated with capture and print unit 330 and configured to generate control signals directing operation of imager 338 and print device 342. In the particular example illustrated, controller 354 receives signals via encoder wheel 361 during manual movement of unit 330 across the surface being printed upon. Based upon the relative movement, controller 354 generates control signals controlling what particular nozzles of print device 342 are fired and the rate at which they are fired to eject ink or other printing material through opening 52 and onto the surface opposite to print device 342.

As shown by FIG. 13, cartridge 200 mounds within door 324, wherein door 324 is pivoted As shown by FIG. 13, in the example illustrated, unit 330 includes a cavity 400 configured to receive print cartridge 200. Unit 330 further includes springs 402 for biasing print device 342 and a communication interface 404 comprising electrical contact or pins making contact with contacts 142 (shown in FIG. 2) for communicating and controlling printing to by print cartridge 200.

Although unit 330 is illustrated as including cartridge 200, unit 330 may alternatively include cartridge 100. Although cartridge 200 is illustrated as being employed with unit 330, cartridge 200 may be employed with other print devices configured to print in a sideways or substantially horizontal orientation. In particular embodiment, cartridge 200 may also be employed in per devices which print while in a substantially vertical orientation, where the ink or other architectural features may otherwise result in air bubbles that become lodged so as to interrupt printing fluid flow. Although fluid delivery systems 122 and 222 are illustrated as being employed as part of removable print cartridges 100 and 200, respectively, in other embodiments, fluid delivery systems 122 and 222 may alternatively be employed in print head assemblies that are not provided as part of removable cartridges or pens. For example, fluid delivery systems 122 and 222 may alternatively be employed in print head assemblies that are replenished with printing fluid by an off-axis ink supply system.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

an ink fluid delivery system comprising:

a fluid chamber;

a standpipe extending from the chamber;

a floor across the standpipe, the floor forming a first slot; and a protuberance projecting from the floor into the standpipe, wherein the protuberance in the standpipe has a width dimension and wherein opposite sides of the protuberance in the standpipe are each spaced from corresponding opposing sides of the standpipe by a spacing greater than the width dimension.

2. The apparatus of claim 1, wherein the first slot has narrowing end portions.

3. The apparatus of claim 2, wherein the narrowing end portions extend outwardly beyond the standpipe.

4. The apparatus of claim 1, wherein the floor is ramped along the first slot, the floor extending from and sloping from one of the sides of the standpipe to the first slot.

5. The apparatus of claim 1, wherein the slot extends along an axis and wherein the protuberance extends substantially perpendicular to the axis.

6. The apparatus of claim 5, wherein the protuberance extends equidistantly from opposite ends of the first slot.

7. The apparatus of claim 1, wherein the first slot extends along an axis and wherein the protuberance includes a main portion extending perpendicular to the first slot and extensions substantially parallel to the first slot.

8. The apparatus of claim 7 further comprising a second protuberance extending into the standpipe proximate an end of the slot.

9. The apparatus of claim 7, further comprising a second slot extending parallel to the first slot, wherein the extensions extend between the first slot and the second slot.

10. The apparatus of claim 1 further comprising a head assembly coupled to the fluid delivery system and including a feed slot and firing circuitry opposite the first slot.

11. The apparatus of claim 1 further comprising a manually held print unit receiving of the fluid delivery system and configured to be oriented so as to support the slot facing in a horizontal direction during printing on a vertical surface.

12. The apparatus of claim 1, wherein the protuberance projects at least about 0.3 mm into the standpipe.

13. The apparatus of claim 1, wherein the first slot has a height less than or equal to about 2 mm.

14. The apparatus of claim 1, wherein the standpipe has a first length and wherein the first slot has a second length greater than the first length by less than or equal to about 6 mm.

15. The apparatus of claim 1, wherein the chamber, the floor and the standpipe are integrally formed as part of a single unitary body.

16. The apparatus of claim 1, wherein the first slot has a first ceiling portion sloping from a first end of the first slot to the standpipe at an angle of at least about 14 degrees and a second ceiling portion sloping from a second end of the first slot to the standpipe at an angle of at least about 54 degrees.

17. The apparatus of claim 1 further comprising one or more supports transversely extending across the first slot, the first slot having a top proximate the standpipe and a bottom distant the standpipe, the one or more supports having a lower surface facing away from the fluid chamber and spaced from the bottom of the first slot by least about 0.7 mm.

18. An apparatus comprising:

an ink fluid delivery system comprising:

a fluid chamber;

a standpipe extending from the chamber;

a floor across the standpipe, the floor forming a slot extending through the floor, wherein the floor is ramped along a length of the slot, the floor extending from and sloping from a side of the standpipe towards a centerline of the standpipe to the slot.

19. An apparatus comprising:

an ink fluid delivery system comprising:

a fluid chamber;

a standpipe extending from the chamber;

a floor across the standpipe, the floor forming a first slot; and a protuberance projecting from the floor into the standpipe, wherein the first slot extends along an axis and wherein the protuberance includes a main portion extending perpendicular to the first slot and extensions substantially parallel to the first slot.

20. The apparatus of claim 19 further comprising a second protuberance extending into the standpipe proximate an end of the slot.

21. The apparatus of claim 19, further comprising a second slot extending parallel to the first slot, wherein the extensions extend between the first slot and the second slot.

22. An apparatus comprising:

an ink fluid delivery system comprising:

a fluid chamber;

a standpipe extending from the chamber;

a floor across the standpipe, the floor forming a first slot having a top proximate the standpipe and a bottom distant the standpipe; and a protuberance projecting from the floor into the standpipe, one or more supports transversely extending across the first slot, the one or more supports each having a lower surface facing away from the fluid chamber and spaced from the bottom of the first slot by least about 0.7 mm.

23. The apparatus of claim 1, wherein the slot extends across and opposite to the standpipe, the slot extending beyond opposite sides of the standpipe.

24. The apparatus of claim 18, wherein the slot extends across and opposite to the standpipe, the slot extending beyond opposite sides of the standpipe.

25. The apparatus of claim 19, wherein the slot extends across and opposite to the standpipe, the slot extending beyond opposite sides of the standpipe.

26. The apparatus of claim 22, wherein the slot extends across and opposite to the standpipe, the slot extending beyond opposite sides of the standpipe.

* * * * *

UNITED STATES PATENT AND TRADEMARK OFFICE

CERTIFICATE OF CORRECTION

PATENT NO. : 8,313,178 B2
APPLICATION NO. : 11/833825
DATED : November 20, 2012
INVENTOR(S) : Anthony D. Studer et al.

It is certified that error appears in the above-identified patent and that said Letters Patent is hereby corrected as shown below:

In column 1, lines 5-20, delete "As shown by FIG. 9, standpipe 224 has a floor 264 which includes sloped or ramped portions 265 that slope or ramp towards slots 226. As a result, ramped portions 265 form an angle with the vertical walls 265 of standpipe 224 that is greater than 90 degrees and also forms an angle with a top of slots 226 that is greater than 90 degrees. Such larger transition angles reduce the likelihood of air bubbles becoming trapped or lodged along floor 264 and proximate to slots 226 where they may at least partially occlude flow of printing fluid. According one embodiment, floor 264 extends at an angle of at least about 160 degrees and nominally about 150 degrees with respect to vertical walls 265 and forms an angle of at least about 130 degrees and nominally about 120 degrees with respect to a top of slots 226. In other embodiments, floor 264 may extend at other angles or may alternatively extend perpendicular to walls 265." and insert -- Fluids are sometimes deposited or printed upon a surface using drop-on-demand inkjet print heads. Reliably delivering fluid from a fluid chamber to the print heads may be difficult or expensive to achieve. --, therefor.

In column 5, line 66, after "160" insert -- degrees --.

In column 5, line 66, after "150" insert -- degrees --.

In column 5, line 67, after "130" insert -- degrees --.

In column 6, line 1, after "120" insert -- degrees --.

Signed and Sealed this
Twelfth Day of March, 2013

Teresa Stanek Rea
*Acting Director of the United States Patent and Trademark Office*